United States Patent [19]

Wilson et al.

[11] Patent Number: 4,553,704

[45] Date of Patent: Nov. 19, 1985

[54] PULVERIZING APPARATUS

[75] Inventors: Robert R. Wilson, Kilmacolm; Roy D. Falconer, Bridge of Weir, both of Scotland

[73] Assignee: James Howden & Company Limited, Glasgow, Scotland

[21] Appl. No.: 581,109

[22] Filed: Feb. 21, 1984

[51] Int. Cl.[4] ..... B02C 19/06

[52] U.S. Cl. ..... 241/39; 241/5

[58] Field of Search ..... 241/5, 39, 40, 119, 241/121

[56] References Cited

U.S. PATENT DOCUMENTS

| | | | |
|---|---|---|---|
| 2,846,151 | 8/1958 | Wehn et al. | 241/39 X |
| 3,719,329 | 3/1973 | Ruzicka . | |
| 4,018,388 | 4/1977 | Andrews | 241/39 |
| 4,219,164 | 8/1980 | Taylor | 241/39 X |

FOREIGN PATENT DOCUMENTS 469068 7/1937 United Kingdom .

*Primary Examiner*—Mark Rosenbaum

*Attorney, Agent, or Firm*—Barnes & Thornburg

[57] ABSTRACT

Pulverizing apparatus comprising a generally cylindrical vessel (11), feed means (16) for feeding the material to be pulverized into said vessel, a plurality of circumferentially spaced fluid injection nozzles (24) each angled between a radius of the cylindrical vessel passing through the nozzles and a direction perpendicular to said radius, to inject fluid into the vessel and induce an axially flowing vortex (25) in the vessel having its axis generally centrally of the vessel, transverse wall means (12) at a location remote from the nozzles to intercept the vortex and to deflect a portion (26) of the fluid medium and entrained particles of material to effect a recirculation of the fluid medium within the vessel and thus to form a curtain surrounding the vortex. The material is pulverized by interparticle collisions and the curtain reduces high speed particle contact with the cylindrical wall of the vessel. An outlet (14) in said transverse wall allows a fraction of the pulverized material below a predetermined mass to pass generally along the axis of the vortex. The means (16) for feeding the material to be pulverized are arranged to feed the material to a point adjacent the axial center of the vessel in the vicinity of said nozzles.

5 Claims, 1 Drawing Figure

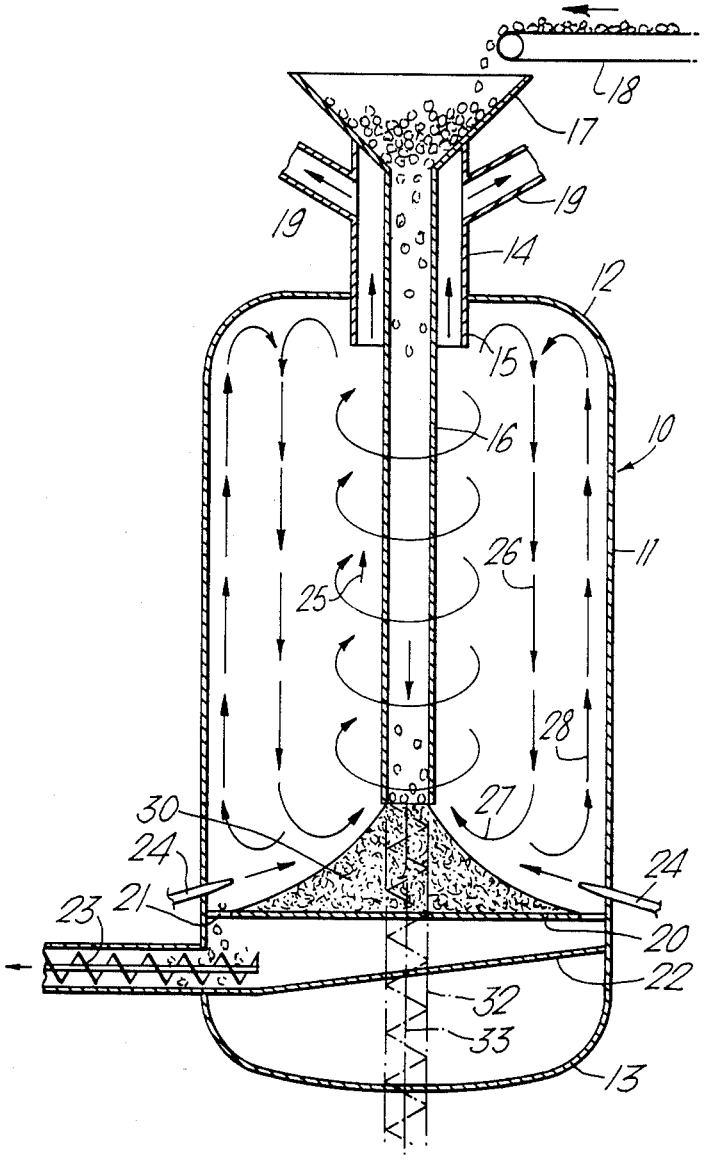
18
17
19
19
14
12
15
16
10
11
26
25
28
27
30
24
24
21
23
20
22
32
33
13

PULVERIZING APPARATUS

The present invention relates to pulverizing apparatus.

It has been proposed, for example, in U.S. Pat. No. 4,219,164 to provide a pulverizing apparatus, for example for use in the pulverizing of coal, which comprises a generally cylindrical vessel having feed means for feeding the material to be pulverized into said vessel, a plurality of circumferentially spaced fluid injection nozzles each angled between a radius to the cylindrical vessel passing through the nozzles and a direction perpendicular to such radius, to inject fluid into the vessel and induce an axially flowing vortex in the vessel, having its axis generally centrally of the vessel, and to provide transverse wall means at a location remote from the nozzles to intercept the vortex and to deflect a portion of the fluid medium and entrained particles of material to effect a recirculation of the fluid medium within the vessel and thus to form a curtain surrounding the vortex, whereby the material is pulverized by interparticle collisions and the curtain reduces high speed particle contact with the cylindrical wall of the vessel. An outlet is provided in the transverse wall through which a fraction of the pulverized material below a predetermined mass will pass generally along the axis of the vortex, the remaining particle sizes being swept out by centrifugal force for recirculation and repulverizing.

Such an apparatus is generally satisfactory but has certain shortcomings. It is an object of the present invention to overcome, at least in part, these shortcomings.

It is now proposed, according to the present invention, that the means for feeding the material to be pulverized should be arranged to feed the material to a point adjacent to the axial centre of the vessel in the vicinity of the nozzles.

Such an arrangement of the feed means ensures that a pile of material to be pulverized is formed on the bottom of the vessel and this pile is generally symmetrical and therefore does not disturb the proper formation of the vortex, thus giving an improved pulverizing effect.

While the feed means can comprise a substantially radially extending screw conveyor having forward feeding flights passing from the feed side substantially to the axis of the vessel and reverse feeding flights beyond the axis, such a feed arrangement has a disadvantage that the screw conveyor can be damaged, and eventually worn out, by particle impact, and the further disadvantage that it disturbs the vortex flow within the vessel. It is therefore preferred that the feed means should extend generally axially through the vessel. Again, while the feed means can include a generally axially extending feed tube through the end wall of the conveyor remote from the transverse wall means, in a preferred arrangement the feed means comprises a generally axially extending feed tube passing through the transverse wall to the point adjacent the axial centre of the vessel in the vicinity of the nozzles. With such an arrangement the feed tube may be surmounted by a feed hopper and the material to be pulverized can flow simply by gravity and can operate in the manner of a chicken feeder, so that the amount of material to be pulverized is controlled by the size of the pile of material on the base.

The feed tube preferably passes through the outlet in the transverse wall, so that the outlet is made annular, and an annular shroud advantageously surrounds the outlet and the feed tube to assist in the cyclone separation of the heavier particles from those particles passing out of the vessel.

In a preferred construction, a base plate is placed within the vessel at a location below the point of feed, and on which a substantially symmetrical pile of material to be pulverized is formed, and at least one opening is provided through said base plate at or near its periphery for the passage of heavy particles, which are not taken up by the vortex. When one is pulverizing coal, for example, there is often a certain amount of stone within the coal and this tends to be heavier than the coal and one, quite clearly, does not wish to include pulverized stone in the pulverized coal. The advantage therefore arises that the heavy material tends to move outwardly from the pile and lodge near the corner of the base plate. By providing openings in the base plate at or near its periphery, this gives an opportunity for the heavier objects to fall below and they can then be conveyed from a location below the base plate. The opening may be in the form of a complete annulus with the base plate supported centrally from below, or could be in the form of a number of spaced openings or notches in the periphery of the base plate itself which is otherwise secured to the cylindrical wall of the vessel, e.g. by welding.

In order that the present invention may more readily be understood, the following description is given, merely by way of example, reference being made to the accompanying drawings, in which the sole FIGURE is a schematic cross-section through one embodiment of apparatus according to the invention.

The apparatus illustrated in the drawing comprises a vessel indicated by the general reference numeral 10 comprising a cylindrical wall 11, a top domed cover 12 and a bottom domed cover 13. Extending axially within the domed cover 12 is an outlet 14 having an annular shroud 15 extending within the internal volume of the vessel 10. Coaxially arranged within the outlet 14 and shroud 15 is a feed tube 16 surmounted by a hopper 17 which may be fed with material, such as coal, to be pulverized by way of a conveyor 18. The outlet 14 is provided with a number, say four, of outlet ducts 19 for feeding the pulverized material on to a point of use, for example to a boiler or further treatment zone.

Adjacent the lower end of the cylindrical wall portion 11 is a base plate 20 which is secured to the cylindrical wall, e.g. by welding and provided with a plurality of circumferentially spaced openings 21. Below the plate 20 and above the domed section 13 is an inclined ramp 22 with a discharge conveyor 23 at its lowest point.

Projecting inwardly into the cylindrical wall 11 of the vessel 10 are a plurality of circumferentially spaced injection nozzles 24 which are arranged to point upwardly somewhat and also at an angle to the radius passing through the nozzle. These nozzles, therefore, induce within the vessel 10 a vortex comprising a central upwardly axially flowing vortex portion 25 which impinges against the transverse wall formed by the upper domed cover 12 so that the stream of fluid flows downwardly to provide a curtain 26 which is peripheral to the core zone 25. The lower end of the downward flow 26 the flow splits into a portion 27 which is recirculated through the upwardly flowing vortex portion and a further circumferential portion 28 which flows upwardly to rejoin the downwardly flowing part 26 adjacent the transverse wall formed by the cover 12.

In operation, material to be pulverized, for example coal, is introduced into the hopper 17 by the conveyor 18 and fills up the feed tube 16 to form a pile 30 which is generally symmetrical because the feed tube is central. The coal particles are picked up by the vortex and swirled around in the manner indicated and there is a considerable amount of interparticle collision which produces a grinding effect. The heavier particles move outwardly in the vortex which is thus in a form of a cyclone separator and pass down the stream 26, while the lighter portions exit through the shroud 15 and outlet 14 to discharge through the outlet ducts 19.

Very heavy particles, for example, stones, are not taken up by the vortex and pass downwardly through the openings 21 onto the ramp 22 for discharge by the conveyor 23.

An alternative feed arrangement is shown in phantom and comprises an upwardly extending axial feed tube 32 having a screw conveyor 33 therewithin. This must be fed from a source (not shown) of the material to be pulverized.

We claim:

1. Pulverizing apparatus comprising a generally cylindrical vessel, a plurality of circumferentially spaced fluid injection nozzles each angled between a radius of the cylindrical vessel passing through the nozzles and a direction perpendicular to said radius, to inject fluid into the vessel and induce an axially flowing vortex in the vessel having its axis generally centrally of the vessel, transverse wall means is said cylindrical vessel, a generally axially extending feed tube passing through the transverse wall means for feeding the material to be pulverized into said vessel, said feed tube extending to a point in said vessel effective to feed the material to a point adjacent the axial center of the vessel in the vicinity of said nozzles, said transverse wall means being positioned at a location remote from the nozzles to intercept the vortex and to deflect a portion of the fluid medium and entrained particles of material to effect a recirculation of the fluid medium within the vessel and thus to form a curtain surrounding the vortex, whereby the material is pulverized by interparticle collisions and the curtain reduces high speed particle contact with the cylindrical wall of the vessel, and an outlet in said transverse wall through which a fraction of the pulverized material below a predetermined mass will pass generally along the axis of the vortex, said feed tube passing through said outlet in the transverse wall, so that the outlet is thus made annular.

2. Apparatus as claimed in claim 1, and further comprising an annular shroud which surrounds said inlet and said feed tube.

3. Apparatus as claimed in claim 1, and further comprising a feed hopper mounted on top of said feed tube whereby material to be fed passes through the feed tube under gravity.

4. Apparatus as claimed in claim 1, and further comprising a base plate placed within said vessel at a location below said point and on which a substantially symmetrical pile of material to be pulverised is, formed and at least one opening through said base plate adjacent its periphery for the passage of heavy particles which are not taken up by the vortex.

5. Apparatus as claimed in claim 4, and further comprising a conveyor positioned to remove said heavy particles from a location below said base plate.

* * * * *